United States Patent [19]

Magan

[11] Patent Number: 4,512,051

[45] Date of Patent: Apr. 23, 1985

[54] HANDTOOL

[76] Inventor: Arthur S. C. Magan, 15, Heytesbury La., Dublin 4, Ireland

[21] Appl. No.: 436,819

[22] Filed: Oct. 26, 1982

[30] Foreign Application Priority Data

Oct. 27, 1981 [IE] Ireland ..... 2508/81

[51] Int. Cl.[3] ..... B25B 7/22

[52] U.S. Cl. ..... 7/128

[58] Field of Search ..... 7/127-129, 7/138; 81/428 R; 30/161

[56] References Cited

U.S. PATENT DOCUMENTS

| | | | |
|---|---|---|---|
| 18,206 | 9/1857 | Lamson | 7/128 |
| 1,171,221 | 2/1916 | Marion | 7/128 |
| 1,262,390 | 4/1918 | Roth | 30/161 |
| 2,286,524 | 6/1942 | Wilbur | 30/161 |
| 2,561,682 | 7/1951 | Barnett | 7/128 X |
| 2,728,984 | 1/1956 | Hopta | 30/161 |
| 2,951,259 | 9/1960 | Brockner | 81/428 R X |
| 4,140,124 | 2/1979 | Curutchet | 81/428 R X |
| 4,238,862 | 12/1980 | Leatherman | 7/128 |

OTHER PUBLICATIONS

"*Everybody Wants Them!*", Esquire, Seaboard Steel Co., Apr. 1952, p. 160.

*Primary Examiner*—James G. Smith

*Attorney, Agent, or Firm*—Young & Thompson

[57] ABSTRACT

A handtool has major and minor body members pivoted to each other, each member having a handle portion and a jaw. The major body member has two blade implements pivotably mounted on an inside edge region of the handle portion, facing the handle portion of the minor body member, and a marlinspike similarly mounted on its outside edge region, the blade implements and spike being rotatable between rest positions in which they are received at least in part in recesses of the handle portion, and working positions in which they extend rearwardly from the body member, away from the jaws. The handle of the minor body member stands outwardly of the blade elements when these are in their rest positions and the tool is in a closed configuration, and the spike has a gripping surface of its outer face. Detent means are provided to retain the implements in their working positions.

2 Claims, 15 Drawing Figures

HANDTOOL

BACKGROUND OF THE INVENTION

1. Field of the Invention

The invention relates to a handtool of the pincer type having at least one implement foldably mounted on a handle portion of the tool. It is particularly suited for use by yachtsmen.

2. Description of the Prior Art

British Patent Specification No. 14,118/1913 describes a pocket-knife for miners' use, including a pincers arm pivoted on the casing of the knife away from the single foldable blade. British Patent Specification No. 698,921 describes an adjustable pliers in which the handle portion of one of the jaws consists of a pocket-knife having a plurality of blades opening outwardly away from the handle portion of the other jaw. British Patent Specification No. 1,411,836 describes a fisherman's tool which has a pocket-knife-like handle portion and a pair of jaws closing in a direction transverse to the plane of opening of the blades of the knife.

These prior art tools do not provide the necessary degree of comfortable and convenient grippability in the handle region which is a prerequisite for safe and effective use of a tool of this type, as a result of the directions in which the blade implements open from the handle portion within which they are housed in their folded condition.

SUMMARY OF THE INVENTION

1. Purposes of the Invention

It is an object of the invention to provide a handtool of the character described which is not subject to the foregoing drawback.

It is another object of the invention to provide a handtool of the character described for the use of yachtsmen and other seafarers, which comprises the implements required for seafaring purposes arranged in convenient and easily usable and accessible manner.

It is another object of the invention to provide storage means for a handtool of the character described, which will enable easy and convenient storage of the tool about the person of a user.

2. Brief Description of the Invention

According to the invention, there is provided a handtool, which comprises:

(a) a substantially elongate major body member;

(b) a substantially elongate minor body member; and (c) at least one implement;

each of the body members having a jaw portion in a front end region and a handle portion in a rear end region, the body members being pivotally connected together intermediate their end regions so that they can be rotated relative to each other by manual operation of the handle portions between a closed condition of the body members in which the jaw portions are in abutment with each other and an open condition of the body members in which the jaw portions are spaced apart from each other; the handle portion of the major body member having an inside edge region which faces the handle portion of the minor body member and said handle portion also having an elongate recess in said inside edge region; and the implement being mounted on the major body member in the inside edge region and being displaceable between a rest position in which it is received at least in part in said recess in the inside edge region and a working position in which it extends rearwardly from the body member. By mounting the implement in the inside edge region of the handle portion of the major body member, the safety and comfort with which the tool may be gripped is improved by comparison with the prior art tools.

In the preferred embodiment, when the body members are in their closed condition and the implement is in its rest position, at least part of the handle portion of the minor body member remains disposed outwardly of the implement in the direction of relative rotation of the body members from their closed condition towards their open condition. Preferably the handle portion of the major body member also has a recess in an outside edge region directed away from the handle portion of the minor body member and the handtool comprises an outside implement mounted on the major body member in the outside edge region, the outside implement being displaceable between a rest position in which it is received at least in part in the recess in the outside edge region and a working position in which it extends rearwardly from the body member, said outside implement having a gripping-surface region which faces outwardly of the body member when the outside implement is in its rest position.

Each of the implements is preferably pivotably mounted on the major body member and is rotatably displaceable between its rest position and its working position. An additional implement may be mounted on the inside edge region of the major body member, the handle portion of the major body member having an additional recess to receive the additional implement in its rest position. In the preferred embodiment the implements mounted on the major body member in the inside edge region thereof comprise blade elements having cutting edges and the outside implement is a marlinspike and the handle portion of the minor body member is received between the two blade elements in the closed condition of the tool. Preferably each of the implements is housed in the handle portion in such a manner that the handle portion and/or one or more of the implements provides an outer profile adapted to be gripped manually and the region of the handle portion exposed when one of the implements is in its working position also provides an outer profile adapted to be gripped manually so that the required safe and comfortable grippability of the tool is achieved.

The major member may also be provided with a hole passing through it between its side surfaces, suitably shaped to form a shackle opener in the preferred embodiment of the invention. This embodiment also includes detent means for preventing displacement of the implements from their working positions towards their rest positions, for example by way of a displaceable detent member engaging detent surfaces on the pivotably mounted implements.

According to another aspect of the invention, there is also provided storing means for a handtool according to the invention comprising a planar base member adapted to receive a strap and having a bracket shaped to receive the shackle opener aperture of the tool, the bracket having a resilient end region to retain the tool thereon when received over the bracket.

The body members of the tool may suitably be moulded from plastics material and provided with metal implements and jaw inserts.

BRIEF DESCRIPTION OF THE DRAWINGS

Embodiments of the handtool according to the invention will now be described by way of example, having regard to the accompanying drawings, of which.

DETAILED DESCRIPTION OF THE DRAWINGS

Figure 1:
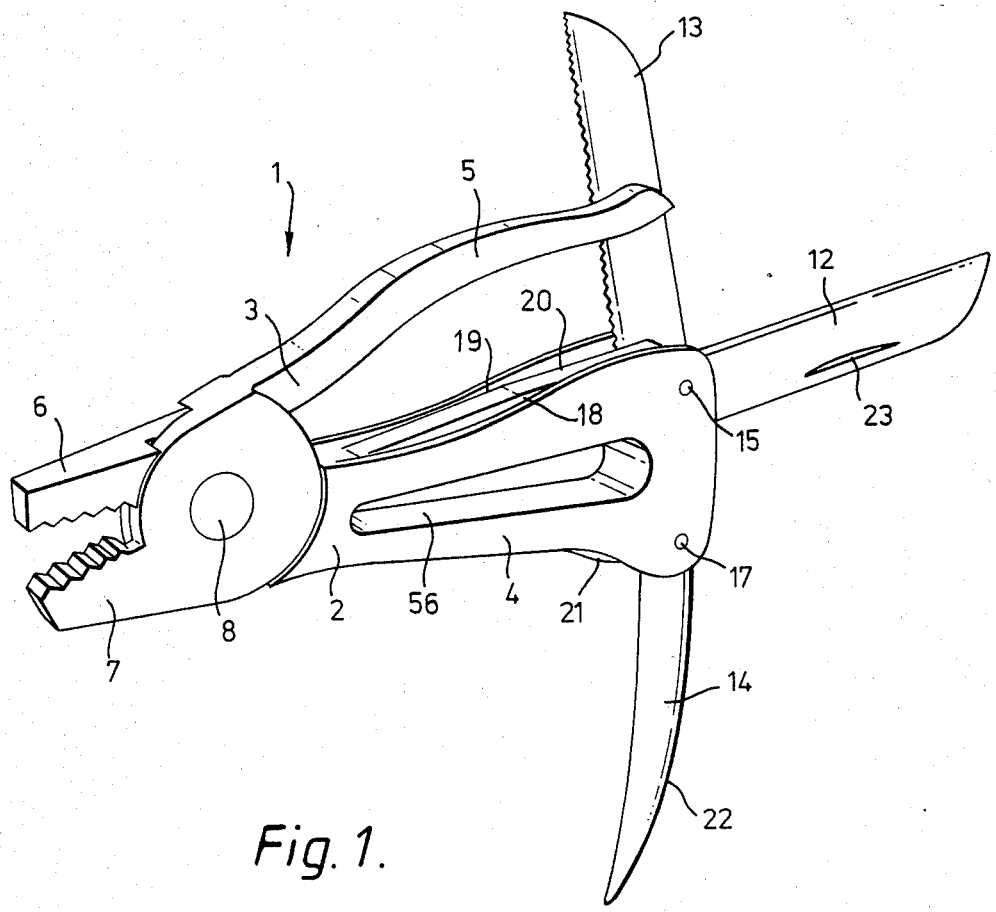
FIG. 1 is a pictorial view of a handtool according to the invention consisting of a pliers provided with a plurality of implements displaceable between working and rest positions.
Figure 2:
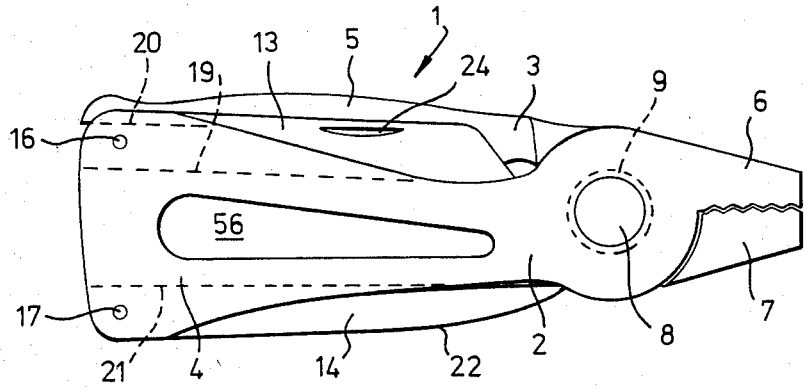
FIG. 2 is a side view of the handtool of FIG. 1 in a closed configuration.

As shown in FIGS. 1 and 2, the handtool 1 according to the invention includes a pliers and is adapted for the use of yachtsmen in particular. The tool has major and minor body members 2 and 3 respectively, each of which has a handle portion 4, 5 respectively in a rear end region, and a jaw 6, 7 respectively in a front end region. The body members are pivoted together on a pin 8 intermediate their ends so that the jaws may be moved towards or away from each other by operation of the handle portions. As illustrated, the jaws are moved towards each other by gripping the pliers in the hand to close the jaws and an object gripped between the jaws can be held between them by continuing to grip the handle portions. In an alternative embodiment, the pivot pin 8 may be replaced by a bush, and this arrangement is especially advantageous for display purposes, in that a number of tools may be supported on a cord or wire threaded through the hollow bush.

Figure 3:
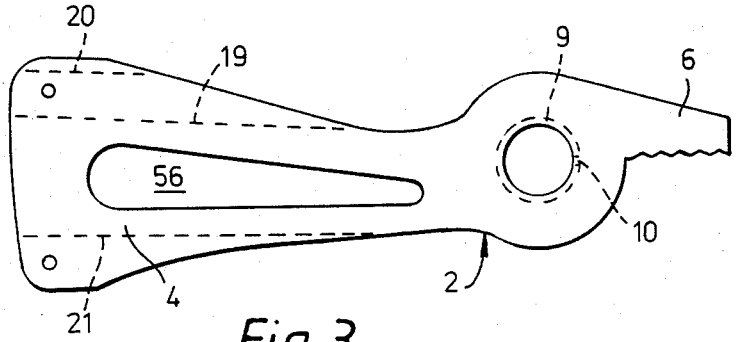
FIG. 3 is a side view of the major body member of the handtool of FIGS. 1 and 2.
Figure 5:
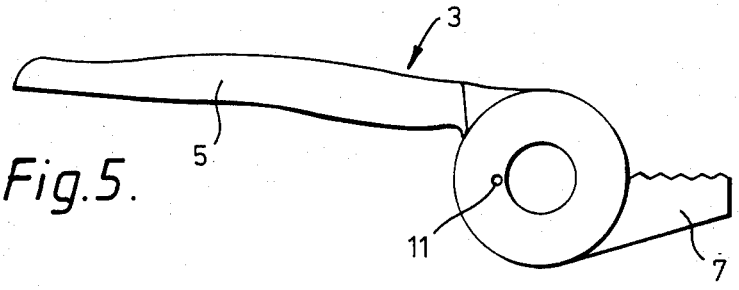
FIG. 5 is a side view of the minor body member of the handtool of FIGS. 1 and 2.

An internal spring is accommodated in a recess 9 in the major body member 2, surrounding the pin 8, and the ends of the spring are received in blind holes in the respective body members 2 and 3, of which one hole 10 in member 2 is indicated in FIG. 3 and the other 11 in FIG. 5. This spring is thus arranged to urge the pliers open, for convenience in use of the tool. The spring is most suitably a coil spring. It will be clear that the space for the spring may also be provided by part recesses in each of members 2 and 3 or alternatively the complete recess may be formed in minor member 3. Similarly the end restraint on the spring may be provided by means such as detent surfaces rather than the blind holes 10 and 11 of FIGS. 3 and 5.

As illustrated in the Figures, in particular in FIG. 5, the minor body member 3 is substantially similar to the corresponding component of a conventional pliers. The major body member 2 by contrast, is provided with a plurality of implements, consisting of a knife 12, a serrated blade or saw 13, and a marlinspike 14, each of which is pivotably mounted at the rear end of the handle portion 4 of the member 2, away from the pivot pin 8, by pins 15, 16 and 17, and is displaceable by rotation through substantially 180° between a working position in which it extends rearwardly from the handle portion 4 and a rest position in which it is received by the major body member. In FIG. 1, blade 12 is shown in its working position, and saw 13 and spike 14 intermediate their working and rest positions. As illustrated in FIG. 2, all three implements 12, 13 and 14 are in their rest positions. The substantially circular cross-section of spike 14 merges into a square or rectangular section portion in the region of the pivot pin 17, to provide side restraint.

Figure 4:
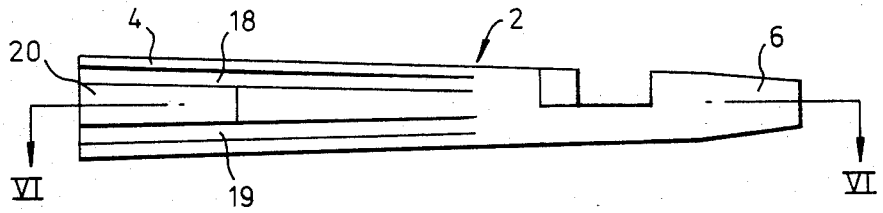
FIG. 4 is a top view of the body member of FIG. 3.

The manner in which the blades 12 and 13 are received by the major member 2 will be seen from FIGS. 1 and 2, and is further apparent from FIGS. 3 and 4. The inside edge region or face of the handle portion 4 which is disposed towards the handle portion 5 of the minor body member 3 in the assembled pliers is provided with two elongate recesses 18 and 19 respectively, each of which is arranged to receive the corresponding blade 12 or 13 in part, in its rest position. The blades are pivoted to the handle portion by the pins 15 and 16 at the rear end thereof, i.e. remote from the pivot pin 8. The recesses 18 and 19 are deepest at said rear end and are reduced in depth towards the pivot pin. They extend along the inside edge region or face of the handle portion and are spaced apart so that when the two blades are in their rest positions, the handle portion 5 of the minor body member 3 can be received between the blades. To facilitate reception of said handle portion 5 the outer end region 20 of the inside edge region or face of the handle portion 4 between the recesses 18 and 19 is also bevelled or reduced in height.

The relative dispositions of the handle portion 5 of the minor body member 3 and the blunt non-cutting edges of the blades 12 and 13 are such that when the blades are in their rest positions and received in the recesses 18 and 19 and the body members are in a closed condition, i.e. the jaws 6 and 7 abut each other, the outer face of the handle portion 5 is disposed outwardly of the blunt non-cutting edges of the blades. Thus even when the tool is in a closed configuration, the handle portion 5 continues to provide a comfortable gripping surface for the user and his hand does not bear against the rear edges of the blades with any degree of pressure.

The marlinspike 14 is accommodated in a recess 21 provided in the outside edge region of the handle portion 4 of the major body member 2, i.e. the face directed away from the minor body member 3, in a similar manner to the blades 12 and 13. This recess is reduced in depth away from the region of the pivotal connection 17 of the marlinspike to the handle portion 4, so that the part of the outside edge region or face of handle portion 4 gripped by a hand when marlinspike 14 is in its working position is substantially smooth. When the handtool is in use to grip or engage items by use of the jaws 6 and 7, the marlinspike 14 is normally disposed in its rest position and forms one of the actual gripping surfaces in contact with the user's hand, and the shapes or profiles of the handle portions of the body members and the shape or profile of the marlinspike are selected or formed so that the handtool is comfortable to hold and easy to operate as a pliers or as a tool using one of the implements in its working position. Preferably the marlinspike 14 has a gripping surface region 22 which faces outwardly of the body member 2 when the spike is in its rest position and provides the required comfortable holding surface in use of the tool with the spike in its rest position.

The body members 2 and 3 may be formed in any suitable manner, e.g. they may be castings or forgings, and suitably machined as required to provide the various faces, recesses etc. However in the preferred embodiment, they are plastics mouldings, in which the various implements are mounted, and have pivot bush inserts and gripping jaw inserts as required. This form of construction facilitates the production of a rugged and heavy-duty multi-purpose tool such as is required in particular for use at sea, combining the functions of a pliers with those of one or more cutting blades and other implements while nonetheless retaining the safe and comfortable grippability which is a feature of the invention.

Figure 6:
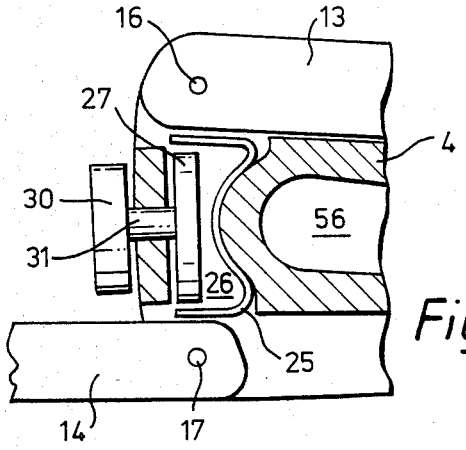
FIG. 6 is a part-sectional view of the rear end region of the major body member of FIGS. 3 and 4 on the line VI—VI of FIG. 4 showing cam and spring means for retaining the implements in the rest or working positions and for urging them towards those positions.
Figure 7:
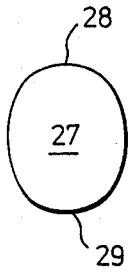
FIG. 7 shows the profile of the cam of the retaining means of FIG. 6.

The blades 12 and 13 may be provided with gripping notches 23 and 24 in known manner to facilitate pivoting them out of their rest positions. It is also desirable that the various implements, i.e. blades 12 and 13 and spike 14, should be locked or held in substantially fixed or rigid manner with respect to the handle portion when in their working positions. One embodiment of means for achieving this is shown in FIGS. 6 and 7 and comprises a leaf or wire spring member or members 25 mounted in a cavity or recess 26 in the end of handle portion 4 remote from the jaw. The end portions of the spring or springs 25 bear against the blades and spike in the regions of their pivotal connections to the handle portion and these regions of the blades and spike have an external cam profile, the cam surfaces thereof engaging the respective spring end portions being closer to the axes of pivots 15, 16 and 17 when the respective implement is in either the rest position or the working position, than they are when the tool is at any disposition intermediate these positions. Thus the action of the spring or springs 25 tends to urge the blades or spike towards one or other end position of pivoting from any intermediate disposition other than dead centre.

In addition means are provided to lock the implements or tools, i.e. blade 12 or 13 spike 14, in the rest position or in the working position. This consists of a cam 27 rotatably mounted at the rear end of the handle portion on an axis substantially parallel to the longitudinal axis of the handle portion and having two opposed cam surfaces 28 and 29, each adapted to engage against a respective end portion of spring or springs 25 when rotated to an appropriate position, and prevent the blades or spike from being pivoted by preventing the spring end portions from moving inwards, so that these bear against the cam surfaces of the implements if rotation thereof is attempted. The cam 27 is manually rotatable through 90° by an external knob 30 to remove the cam surfaces from their rotation-inhibiting engagement against the end portions of spring or springs 25 to a free position. The knob 30 is fixedly connected to the cam 27 by a shaft 31, which is rotatably supported in an aperture in the longitudinally outer end of the handle portion 4.

Figure 8:
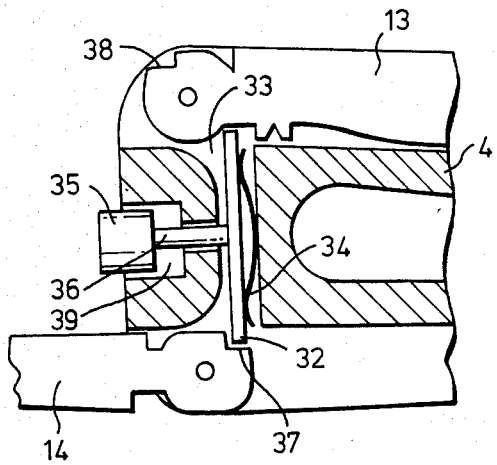
FIG. 8 is a view similar to that of FIG. 6, showing an alternative form of detent means for preventing displacement of the implements from their working positions towards their rest positions.
Figure 9:
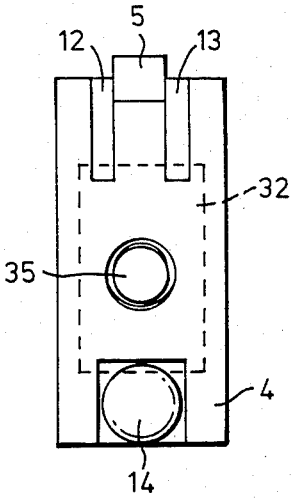
FIG. 9 is an end view of the major body member incorporating the detent means of FIG. 8.

In an alternative form of detent means for retaining the blades and spike in their working positions shown in FIGS. 8 and 9, a plate 32 contained or housed in a cavity or recess 33 in the end region of the member 4 is displaceable in the direction of the longitudinal axis of the member. It is urged outwardly by a leaf or plate spring 34, against which it may be pressed inwardly by external manual pressure on a button 35 on the rear face of the handle portion. The button 35 is fixedly connected to the plate 32 by a shaft 36 which is axially slidable in an aperture in the longitudinally outer end of the handle portion 4. When a blade or the spike is in the working position, which position is shown for the spike in FIG. 8, one end of the plate 32 engages in a detent notch or surface 37 or 38 provided on the implement in question in the region of its pivotal mounting on the member 2. It is retained in engagement with this detent surface by the action of the spring 32. To rotate the implement back towards its rest position, the button 35 must be depressed to move the plate axially inwards and allow the detent surface to pass by the end of the plate. Similarly, notches are provided to accommodate the ends of the plate when the implements are in their rest positions, but in this case the ends of the plates do not bear against detent surfaces, and the implements can be moved away from their rest positions by simple rotation, without depression of the button, the plate 32 riding up on the curved cam surface, which urges it axially inwardly against the spring pressure, during rotation of the implements from the rest positions.

Figure 10:
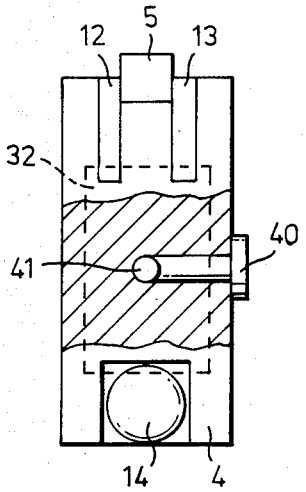
FIG. 10 is a part-sectional end view of the major body member showing an alternative operating means for the detent means of FIGS. 8 and 9.

In place of the leaf or plate spring illustrated in FIG. 8, a coil spring may be provided in the cavity 39, behind the operating button. This arrangement functions similarly to that of FIG. 8, but may provide a more compact construction. FIG. 10 is an end view similar to FIG. 9 and shows another arrangement of the operating button. In this case the button 40 is slidably disposed on a side surface of the handle portion and is connected to a longitudinally slidable shaft 41 attached to the plate 32 by a laterally extending member 42 passing through an elongate slot in the side of the handle portion. Displacement of the plate is thus brought about by movement of the slidable button on the side of the handle portion in one or other direction substantially along the longitudinal axis of the major body member.

Figure 11:
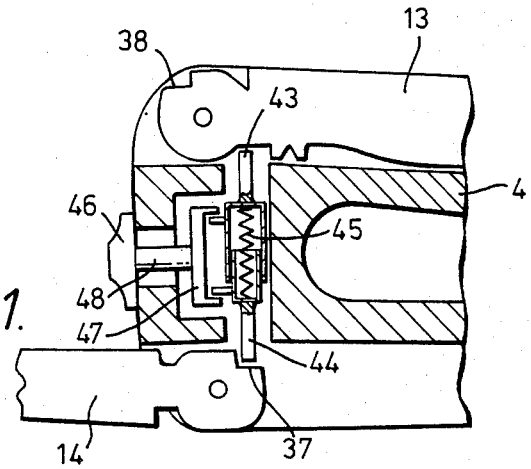
FIG. 11 is a view similar to that of FIG. 8, showing a further form of detent means.

The arrangement shown in FIG. 11 for retaining the blades and spike in their working positions is similar to that of FIGS. 8, 9 and 10 but instead of the plate 32, elongate detent members 43 and 44 are provided, which are telescopically axially slidable with respect to one another in a direction transverse to the longitudinal axis of the handle portion and urged apart by means of an internal spring 45 so that member 44 serves to retain the spike in its working position and member 43 the blades. In this case release of the implement from its working position is brought about by a sliding movement of an external button 46 which is fixedly connected to a jaw member 47 by a shaft 48 passing through an aperture in the outer end region of the handle portion 4 shaped to allow lateral movement of the shaft. The ends of the jaw members 47 engage pins attached to the detent members 43 and 44 respectively so that a respective detent member may be moved away from the notch or detent surface of the implement which it engages by appropriate sliding displacement of the button 46 towards one or other edge region of handle portion 4. As in the case of the arrangements of FIGS. 8, 9 and 10 movement of the implements from their rest positions is not inhibited by the detent members.

Figure 12:
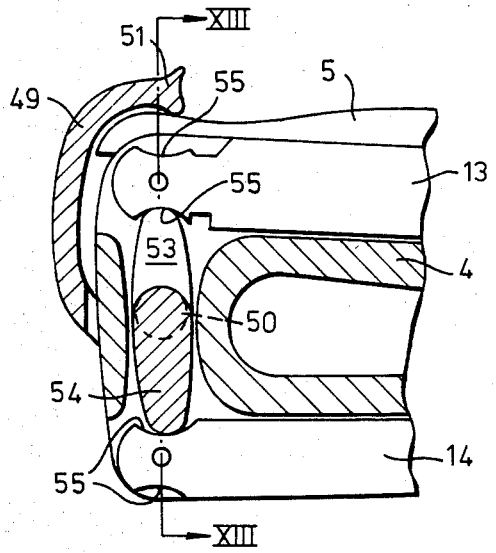
FIG. 12 shows yet another detent means, in a view similar to those of FIGS. 6, 8 and 11, which also includes a latch for securing the minor body member in the closed condition of the body members.
Figure 13:
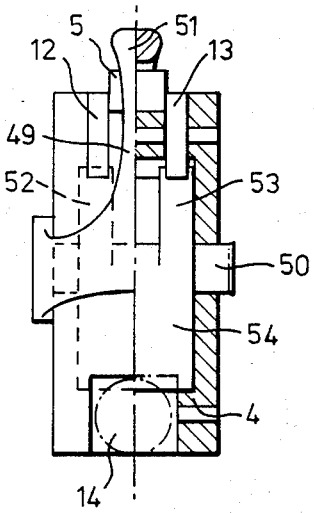
FIG. 13 is an end view of the major body member incorporating the detent means of FIG. 12, in part section on the line XIII—XIII of FIG. 12.

The further construction of detent means shown in FIGS. 12 and 13 also allows the handle portion 5 to be locked or latched in the closed condition of the body members, with the jaws in abutment. The latch for the handle portion 5 consists of a resilient arm 49 which is fixed to a shaft 50 pivotally mounted in the outer end region of the body member. To hold the handle portion 5 in the closed condition, the resilient arm is pushed over the outer end of the handle portion where its end portion 51 springs into a correspondingly profiled depression in the end of the handle portion. The shaft 50 is also provided with three cam lobes 52, 53 and 54, of which lobes 52 and 53 serve to retain the blades 12 and 13 respectively in either the working position or the rest position while lobe 54 fulfils the same function for spike 14. The pivot ends of the blades and spike are provided with recesses 55 which engage the ends of the lobes when the implements are in either the rest or working positions and the lobes are in a locking configuration. The lobes are moved between a locking configuration and a release position by pivoting of the arm 49, which rotates the shaft 50 and as a result the lobes. When the lobes are pivoted out of the recesses 55, the blades or spike may be rotated from the working to the rest position or vice versa, and then locked in that position by moving the lobes back into engagement with an appropriate recess.

It is an advantageous feature of the construction described, in which the handle portion of the major body member carries a plurality of implements, that this handle portion can also be provided with a slot-form opening 56 forming a shackle opener. As shown in the drawings, this is in the form of a through hole in the handle portion 4 extending between its side surfaces but it may also consist of an elongate recess or slot in a side surface of the handle portion. It will be apparent that this opening may also assume different shapes or configurations, to serve purposes other than the opening or closing of shackles.

Figure 14:
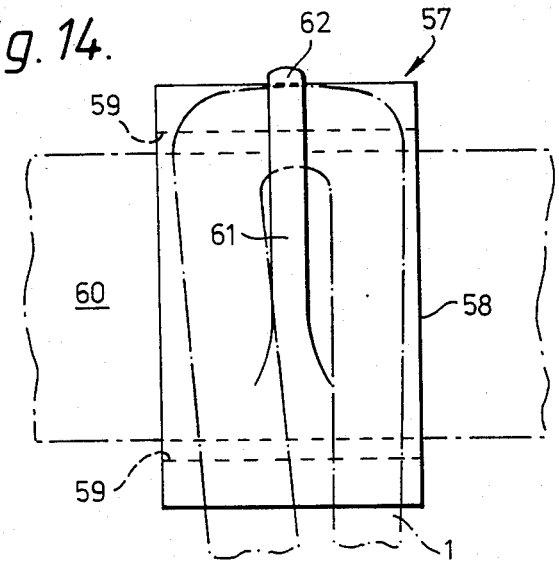
FIG. 14 is a front view of a storing means for the handtool of FIG. 1, which consists of an attachment for a belt provided with a bracket or clip for grasping the tool.
Figure 15:
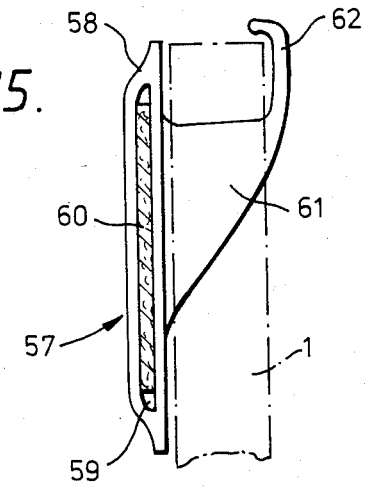
FIG. 15 is a side view of the attachment of FIG. 13.

A shackle opener in the form of a through aperture also serves for convenient storage of the tool of the invention on the person of a user by means of the arrangement of FIGS. 14 and 15. A fitting 57 has a substantially planar portion 58 through which a slot 59 shaped to accommodate a belt 60 extends. The fitting can thus be attached to a yachtsman's belt.

A bracket or clip part 61 extends outwardly from the planar portion and is shaped to allow the aperture 56 of a tool according to the invention to be fitted over it. The outer extremity 62 of the bracket is resilient so that it can be snapped over the tool when this is received on the bracket. This fitting provides a secure and convenient support for the tool from which it may be readily retrieved when required for use. The fitting 57 is thus most suitably formed from a resilient plastics material.

It will be clear that the handtool according to the invention may also encompass other handtools apart from pliers, e.g. cutters or the like devices. In addition, each body member may include one or more implements, but in the preferred embodiment shown, the implements are comprised in the handle portion of the major body member only. It will also be appreciated that the implements provided on the pliers or other handtool may be of various kinds, and while those shown are of particular use to the yachtsman, other implements may be provided for other activities or trades.

I claim:

1. A handtool which comprises: (a) a substantially elongate major body member; (b) a substantially elongate minor body member; (c) at least one inside implement; and (d) an outside implement; each of the body members having a jaw portion in a front end region and a handle portion in a rear end region, the body members being pivotally connected together intermediate their end regions so that they can be rotated relative to each other by manual operation of the handle portions between a closed condition of the body members in which the jaw portions are in abutment with each other and an open condition of the body members in which the jaw portions are spaced apart from each other; the handle portion of the major body member having an inside edge region which faces the handle portion of the minor body member and said handle portion also having an elongate recess in said inside edge region; said at least one inside implement being pivotably mounted on the major body member in the inside edge region and being rotatably displaceable between a rest position in which it is received at least in part in said recess in the inside edge region and a working position in which it extends rearwardly from the body member; the handle portion of the major body member also having a recess in an outside edge region directed away from the handle portion of the minor body member, the outside implement being pivotably mounted on the major body member in the outside edge region and being rotatably displaceable between a rest position in which it is received at least in part in the recess in the outside edge region and a working position in which it extends rearwardly from the body member, and said outside implement having a gripping-surface region which faces outwardly of the body member when the outside implement is in its rest position; and the handle portion of the major body member having in addition an elongate slot-form opening in a side surface thereof, said opening defining a shackle opener; the handtool further comprising detent means for preventing displacement of the implements from their working positions towards their rest positions, each implement having a detent surface in the region of its pivotal mounting on the body member, the detent means comprising at least one detent member displaceable between a blocking position in which it engages a said detent surface to prevent pivoting displacement of the corresponding implement from its working position and a release position in which the implement may be rotated towards its rest position, and the handle portion of the major body member comprising means for holding said at least one detent member in its blocking position and manual means associated with said holding means and selectively operable to allow displacement of the corresponding implement from its working position towards its rest position, said at least one detent member being a spring mounted in the major body member to resiliently engage the corresponding implement in the region of its detent surface, the detent member holding means being a cam member mounted in the major body member for rotation between a locking position in which a cam surface of the cam member engages against a portion of said spring-form detent member to maintain the detent member in its blocking position and a free position in which said spring-form detent member may be displaced into its release position by rotation of the implement, and the manual means being a knob rotatably mounted in and extending outwardly of the major body member and fixedly connected with the cam member, so that the cam member may be rotated by rotation of the knob.

2. A handtool which comprises: (a) a substantially elongate major body member; (b) a substantially elongate minor body member; (c) at least one inside implement; and (d) an outside implement; each of the body members having a jaw portion in a front end region and a handle portion in a rear end region, the body members being pivotally connected together intermediate their end regions so that they can be rotated relative to each other by manual operation of the handle portions between a closed condition of the body members in which the jaw portions are in abutment with each other and an open condition of the body members in which the jaw portions are spaced apart from each other; the handle portion of the major body member having an inside edge region which faces the handle portion of the minor body member and said handle portion also having an elongate recess in said inside edge region; said at least one inside implement being pivotably mounted on the major body member in the inside edge region and being rotatably displaceable between a rest position in which it is received at least in part in said recess in the inside edge region and a working position in which it extends rearwardly from the body member; the handle portion of the major body member also having a recess in an outside edge region directed away from the handle portion of the minor body member, the outside implement being pivotably mounted on the major body member in the outside edge region and being rotatably displaceable between a rest position in which it is received at least in part in the recess in the outside edge region and a working position in which it extends rearwardly from the body member, and said outside implement having a gripping-surface region which faces outwardly of the body member when the outside implement is in its rest position; and the handle portion of the major body member having in addition an elongate slot-form opening in a side surface thereof, said opening defining a shackle opener; the handtool further comprising detent means for preventing displacement of the implements from their working positions towards their rest positions, each implement having a detent surface in the region of its pivotal mounting on the body member, the detent means comprising at least one detent member displaceable between a blocking position in which it engages a said detent surface to prevent pivoting displacement of the corresponding implement from its working position and a release position in which the implement may be rotated towards its rest position, and the handle portion of the major body member comprising means for holding said at least one detent member in its blocking position and manual means associated with said holding means and selectively operable to allow displacement of the corresponding implement from its working position towards its rest position, said at least one detent member being a plate disposed substantially transverse to the longitudinal axis of the major body member and displaceable in the direction of said longitudinal axis between its blocking and release positions, the detent member holding means being a spring mounted in the major body portion to urge said plate towards its blocking position, and the manual means being a button slidably mounted in and extending outwardly of the major body member, so that the plate may be axially displaced from its blocking position towards its release position by depression of the button.

* * * * *